US009109744B1

(12) United States Patent
Guerrero

(10) Patent No.: US 9,109,744 B1
(45) Date of Patent: Aug. 18, 2015

(54) BEVERAGE CONTAINER HOLDING DEVICE

(71) Applicant: Hector F. Guerrero, Salida, CA (US)

(72) Inventor: Hector F. Guerrero, Salida, CA (US)

( * ) Notice: Subject to any disclaimer, the term of this patent is extended or adjusted under 35 U.S.C. 154(b) by 0 days.

(21) Appl. No.: 14/173,592

(22) Filed: Feb. 5, 2014

(51) Int. Cl.
*A47G 1/17* (2006.01)
*F16M 13/02* (2006.01)

(52) U.S. Cl.
CPC ..... *F16M 13/022* (2013.01)

(58) Field of Classification Search
CPC combination set(s) only.
See application file for complete search history.

(56) References Cited

U.S. PATENT DOCUMENTS 2,496,478 A * 2/1950 Kinnebrew ..... 248/103
2,605,069 A * 7/1952 Gillaspy ..... 248/103
2,711,872 A * 6/1955 Lampke ..... 248/103
3,041,034 A * 6/1962 Wilkinson ..... 248/284.1
3,398,919 A * 8/1968 Tokar ..... 248/103
3,627,244 A * 12/1971 Nicholas ..... 248/103
3,913,878 A * 10/1975 Wayne ..... 248/311.2
4,034,945 A * 7/1977 Sato ..... 248/103
4,225,106 A * 9/1980 Eplan ..... 248/282.1
4,453,695 A * 6/1984 Sennott et al. ..... 248/660
4,535,923 A * 8/1985 Manke ..... 224/550
4,697,780 A * 10/1987 Wenkman et al. ..... 248/558
4,712,313 A * 12/1987 Gettleman ..... 34/97
4,721,276 A * 1/1988 Moss ..... 248/311.2
4,735,388 A * 4/1988 Marks ..... 248/103
4,802,602 A * 2/1989 Evans et al. ..... 220/739
4,951,997 A * 8/1990 Kenney ..... 297/188.21
4,957,254 A * 9/1990 Hill et al. ..... 248/207
5,092,549 A * 3/1992 Beech ..... 248/103
5,100,091 A * 3/1992 Pollak ..... 248/278.1
5,295,650 A * 3/1994 Brandt ..... 248/311.2
5,325,991 A * 7/1994 Williams ..... 220/739
5,356,107 A * 10/1994 Sinohuiz ..... 248/311.2
5,409,190 A * 4/1995 Mattox ..... 248/315
5,474,272 A 12/1995 Thompson et al.
5,664,746 A * 9/1997 Benzakarya ..... 248/106
5,695,162 A * 12/1997 DiCastro ..... 248/231.81
5,769,372 A * 6/1998 Klosterman ..... 248/219.4
5,775,654 A * 7/1998 Price ..... 248/231.61
5,813,646 A * 9/1998 Bartholomae ..... 248/311.2
5,823,486 A 10/1998 Smith
5,853,158 A * 12/1998 Riggle ..... 248/311.2
6,010,104 A * 1/2000 Hanson et al. ..... 248/311.2
6,056,246 A * 5/2000 Argy, II ..... 248/103
6,064,426 A * 5/2000 Waterman ..... 348/63
6,145,715 A * 11/2000 Slonim ..... 224/148.3
6,193,202 B1 2/2001 Rogers
6,227,511 B1 * 5/2001 De Costa ..... 248/311.2
6,286,798 B1 9/2001 Chun
6,318,689 B1 11/2001 Rodriguez
6,325,350 B1 * 12/2001 Mancuso ..... 248/311.2
6,520,576 B1 * 2/2003 Burns et al. ..... 297/188.14
6,601,813 B1 * 8/2003 Kager et al. ..... 248/314
6,896,231 B1 * 5/2005 Sullivan, Sr. ..... 248/311.2

(Continued)

*Primary Examiner* — Monica Millner

(57) ABSTRACT

A beverage container holding device provides a portable structure into which a beverage container may be placed and maintained at a cool temperature. The device includes a receiver having a bottom wall and a perimeter wall coupled to and extending upwardly from the bottom wall. The bottom wall and the perimeter wall define an interior space of the receiver configured to receive a beverage container therein. An upper edge of the receiver defines an access opening into the interior space of the receiver. An arm is coupled to the receiver. The arm is configured for attaching to a support structure to support the beverage container from the support structure. The arm is movably coupled to the receiver such that the arm is positionable at a selectable location relative to the receiver.

13 Claims, 4 Drawing Sheets

(56) References Cited

U.S. PATENT DOCUMENTS

| | | | | |
|---|---|---|---|---|
| 7,641,156 | B2 | 1/2010 | Medders et al. | |
| 7,677,407 | B2 * | 3/2010 | Davis | 220/739 |
| 7,748,666 | B2 * | 7/2010 | Oddsen et al. | 248/123.11 |
| 7,753,330 | B2 * | 7/2010 | Brief | 248/278.1 |
| 7,793,904 | B2 * | 9/2010 | Scarton et al. | 248/311.2 |
| 7,793,905 | B2 * | 9/2010 | Merritt et al. | 248/315 |
| 8,128,045 | B2 * | 3/2012 | Skaggs | 248/311.2 |
| D673,816 | S | 1/2013 | Phillips | |
| 8,490,936 | B2 * | 7/2013 | Rinck | 248/309.4 |
| 8,671,847 | B2 * | 3/2014 | Lymberis | 108/42 |
| 8,777,307 | B2 * | 7/2014 | Nelson et al. | 297/188.18 |
| 8,870,044 | B1 * | 10/2014 | Freese et al. | 224/558 |
| 2002/0125262 | A1 * | 9/2002 | Canfield | 220/739 |
| 2004/0104255 | A1 * | 6/2004 | Trautman | 224/413 |
| 2008/0061195 | A1 * | 3/2008 | Carnevali | 248/125.8 |
| 2010/0116955 | A1 * | 5/2010 | Hayes et al. | 248/206.5 |
| 2012/0284969 | A1 * | 11/2012 | Fullerton et al. | 24/303 |

* cited by examiner

BEVERAGE CONTAINER HOLDING DEVICE

BACKGROUND OF THE DISCLOSURE

Field of the Disclosure

The disclosure relates to beverage container support assemblies and more particularly pertains to a new beverage container support assembly for providing a portable structure into which a beverage container may be placed and maintained at a cool temperature.

SUMMARY OF THE DISCLOSURE

An embodiment of the disclosure meets the needs presented above by generally comprising a receiver having a bottom wall and a perimeter wall coupled to and extending upwardly from the bottom wall. The bottom wall and the perimeter wall define an interior space of the receiver configured to receive a beverage container therein. An upper edge of the receiver defines an access opening into the interior space of the receiver. An arm is coupled to the receiver. The arm is configured for attaching to a support structure to support the beverage container from the support structure. The arm is movably coupled to the receiver such that the arm is positionable at a selectable location relative to the receiver.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
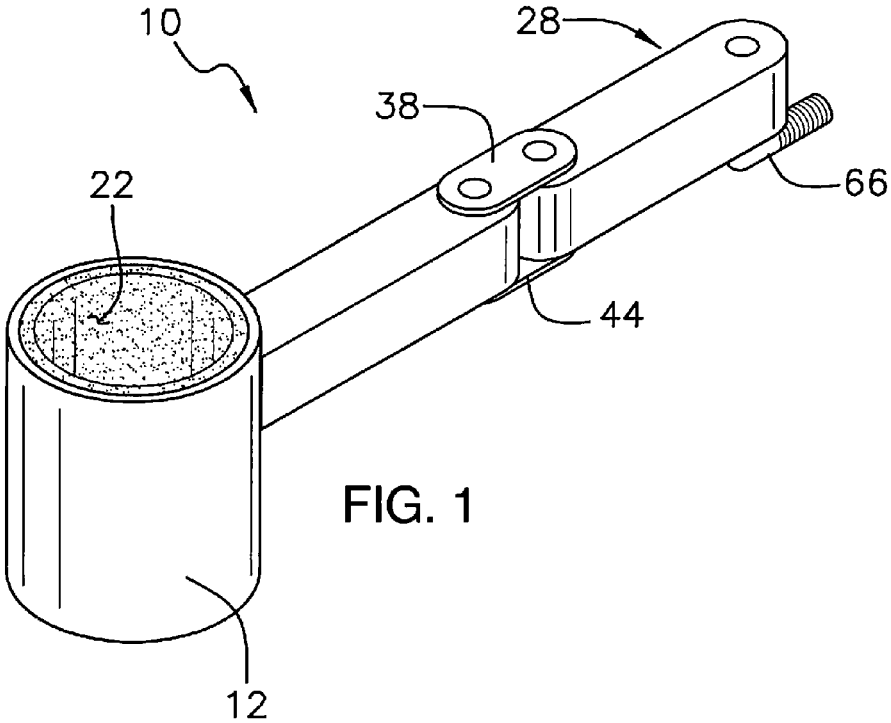
FIG. 1 is front perspective view of a beverage container holding device according to an embodiment of the disclosure.
Figure 2:
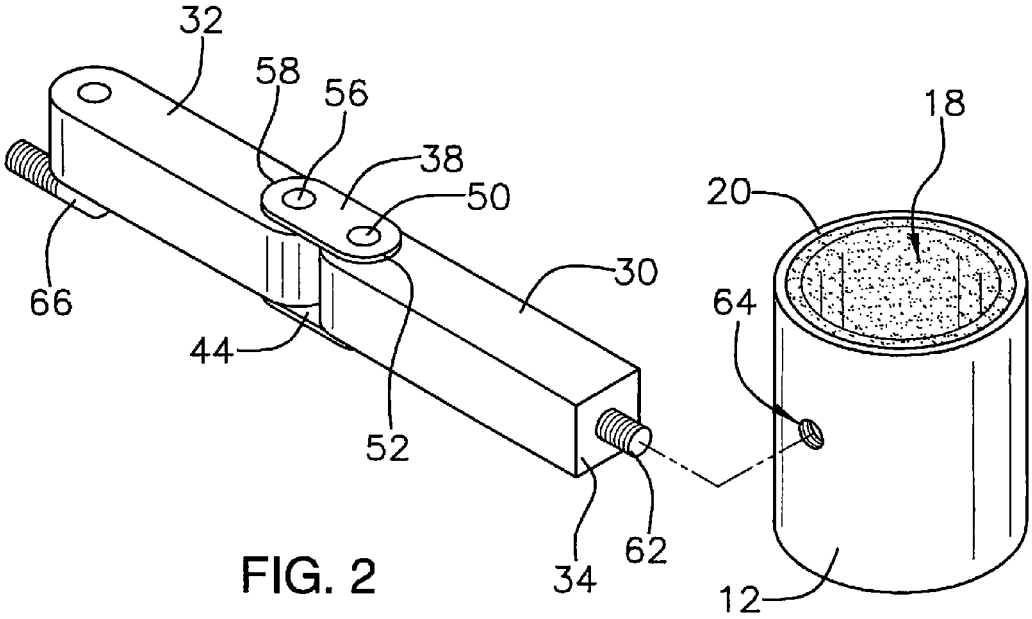
FIG. 2 is a partially-exploded rear perspective view of an embodiment of the disclosure.
Figure 3:
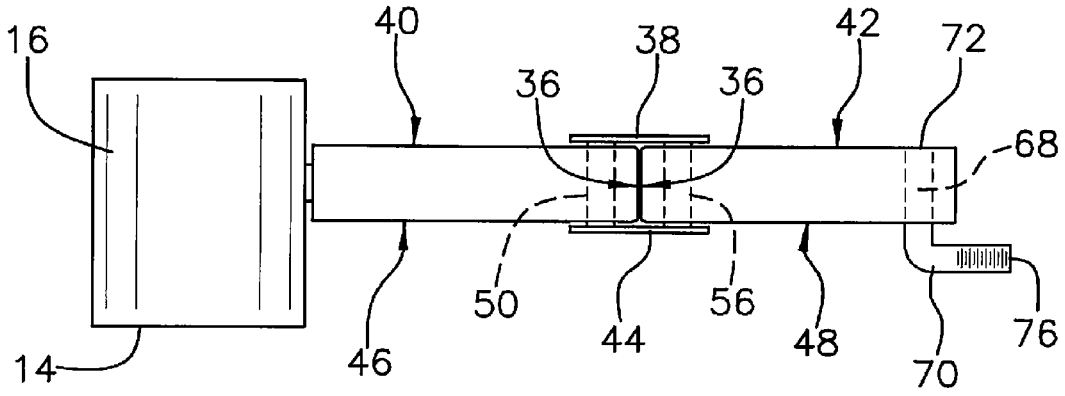
FIG. 3 is a side view of an embodiment of the disclosure.
Figure 4:
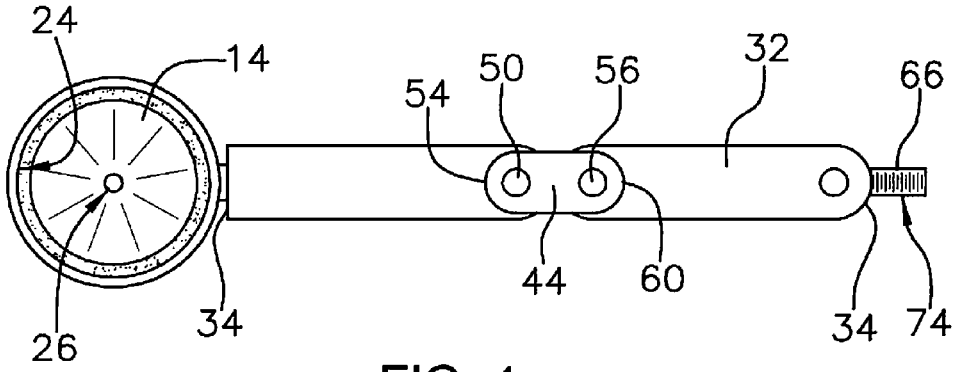
FIG. 4 is a top view of an embodiment of the disclosure.
Figure 5:
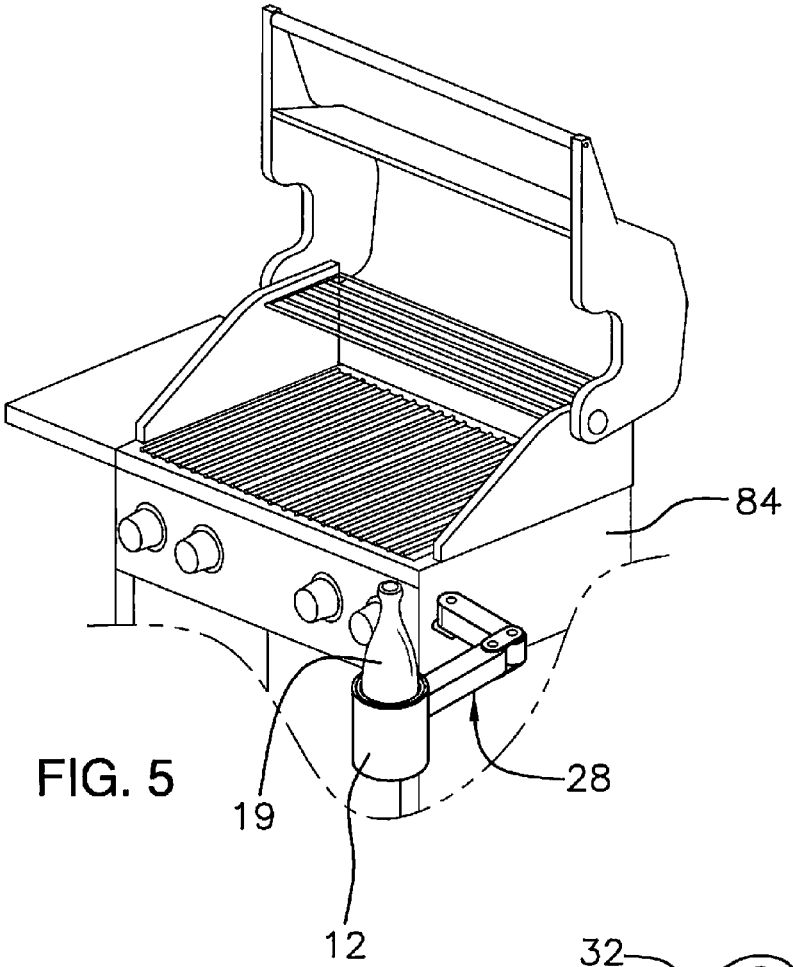
FIG. 5 is an in-use perspective view of an embodiment of the disclosure.
Figure 6:
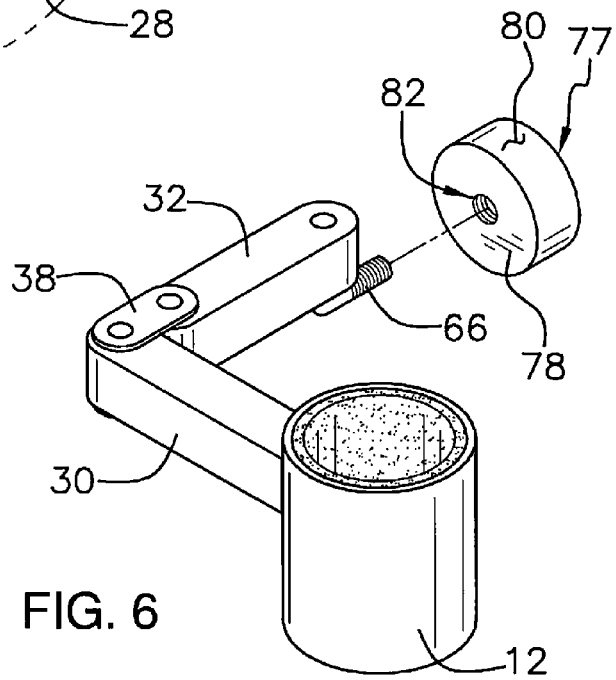
FIG. 6 is a top front side perspective view of an embodiment of the disclosure.
Figure 7:
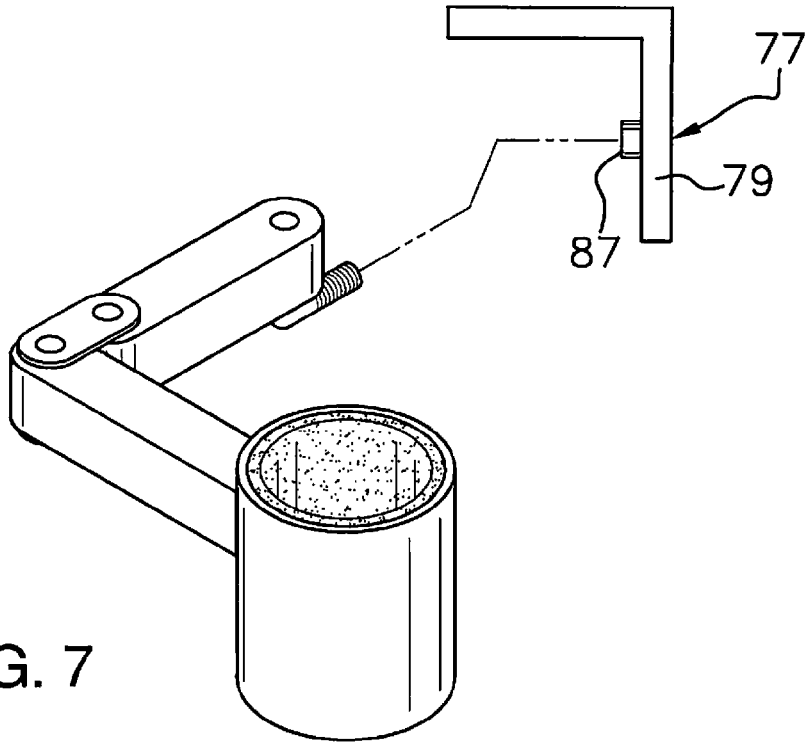
FIG. 7 is a top front side perspective view of an embodiment of the disclosure similar to FIG. 6, except that FIG. 7 shows a bracket as the attachment member.
Figure 8:
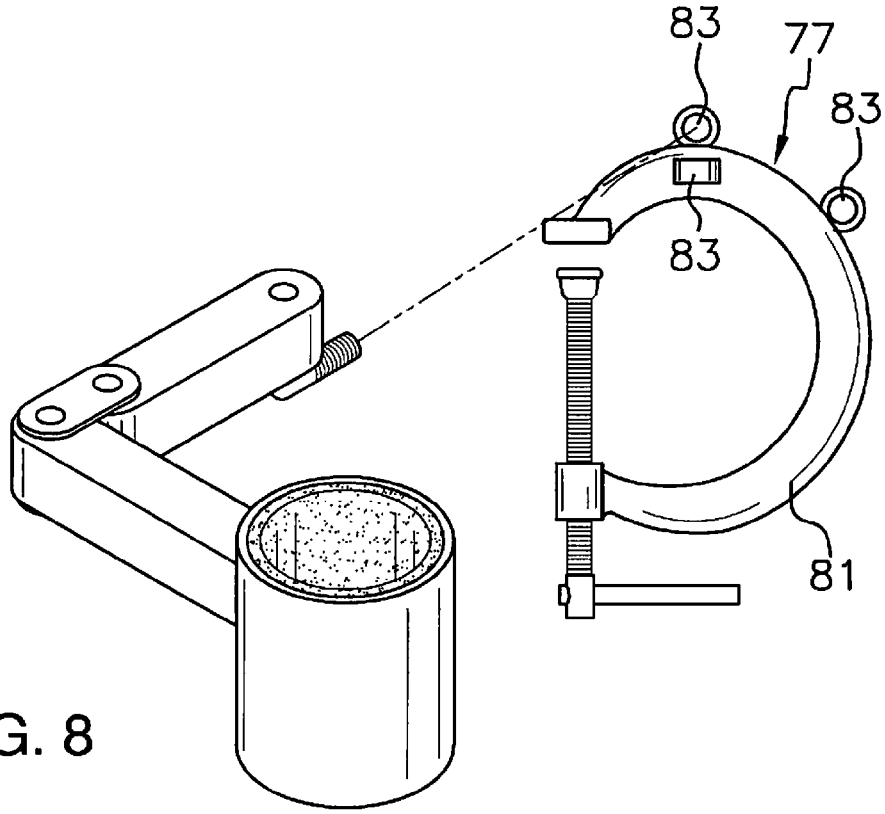
FIG. 8 is a top front side perspective view of an embodiment of the disclosure similar to FIGS. 6 and 7, except that FIG. 8 shows a clamp as the attachment member.

With reference now to the drawings, and in particular to FIGS. 1 through 8 thereof, a new beverage container support assembly embodying the principles and concepts of an embodiment of the disclosure and generally designated by the reference numeral 10 will be described.

As best illustrated in FIGS. 1 through 8, the beverage container holding device 10 generally comprises a receiver 12 having a bottom wall 14 and a perimeter wall 16 coupled to and extending upwardly from the bottom wall 14. The bottom wall 14 and the perimeter wall 16 define an interior space 18 of the receiver 12 configured to receive a beverage container 19 therein. An upper edge 20 of the receiver 12 defines an access opening into the receiver 12. An insulating material 22 is coupled to the receiver 12 wherein the insulating material 22 is configured for preventing heat transfer between the interior space 18 and an extrinsic environment relative to the interior space 18 through the receiver 12. The insulating material 22 lines an inner surface 24 of the perimeter wall 16. The insulating material 22 may have a thickness between approximately 0.25 centimeters and 1.5 centimeters. A hole 26 is positioned in the bottom wall 14 of the receiver 12 to allow condensation or spills from the beverage container 19 to drain therethrough. The receiver 12 may be constructed from a non-corrosive material, such as plastic or the like.

An arm 28 is coupled to the perimeter wall 16 of the receiver 12. The arm is configured for attaching to a support structure 84 to support the beverage container 19 from the support structure 84. The arm 28 may comprise a first member 30 and a second member 32 pivotally coupled together. Each of the first 30 and second 32 members has an outer end 34 and an inner end 36. Each of the inner ends 36 may be convexly arcuate. Each of the first member 30 and the second member 32 may have a length between approximately 12.0 centimeters and 18.0 centimeters. The arm 28 may also be constructed from a non-corrosive material, such as plastic or the like.

An upper plate 38 and a lower plate 44 are provided. The upper plate 38 is coupled to a top surface 40 of the first member 30 and a top surface 42 of the second member 32. The upper plate 38 extends between the first 30 and second 32 members proximate the inner ends 36. The lower plate 44 is coupled to a bottom surface 46 of the first member 30 and a bottom surface 48 of the second member 32. The lower plate 44 extends between the first 30 and second 32 members proximate the inner ends 36. A first fastener 50 extends through each of the first member 30, the upper plate 38 and the lower plate 44. The first fastener 50 releasably couples a first end 52 of the upper plate 38 and a first end 54 of the lower plate 44 to the first member 30 proximate the inner end 36 of the first member 30. A second fastener 56 extends through each of the second member 32, the upper plate 38 and the lower plate 44. The second fastener 56 releasably couples a second end 58 of the upper plate 38 and a second end 60 of the lower plate 44 to the second member 32 proximate the inner end 36 of the second member 32.

A coupler 62 is coupled to and extends outwardly from the first member 30. The coupler 62 couples the arm 28 to the receiver 12. An aperture 64 is positioned in the perimeter wall 16 of the receiver 12. The aperture 64 and the coupler 62 are threaded complementarily wherein the coupler 62 is configured to threadably engage the aperture 64. A connector 66 is coupled to and extends outwardly from the second member 32. The connector 66 may include an upper portion 68 and a lower portion 70 positioned transversely relative to each other. The upper portion 68 has an upper end 72 extending into the second member 32 and positioned proximate the outer end 34 of the second member 32. The lower portion 70 has a threaded section 74 extending inwardly from a distal end 76 of the lower portion 70 with respect to the upper portion 68.

A plurality of attachment members 77 is provided. A selectable one of the attachment members 77 is coupled to the connector 66. The attachment members 77 are configured for attaching the arm 28 to the support structure 84. One of the attachment members 77 comprises a magnet 78 that is releasably couplable to the second member 32 of the arm 28. The magnet 78 may have an annular perimeter surface 80. The magnet 78 has an opening 82 extending therethrough. The opening 82 is threaded complementarily relative to the lower portion 70 of the connector 66 wherein the magnet 78 is configured to threadably engage the connector 66 to support the magnet 78 on the arm 28. The opening 82 may have a diameter between approximately 7.0 centimeters and 13.0 centimeters. One of the attachment members 77 comprises a bracket 79 and another one of the attachment members 77 comprises a clamp 81. Conventional screws or the like are used to attach the bracket 79 to the support structure 84. A nut 87 is attached to the bracket 79. The connector 66 is removably couplable to the nut 87 to attach the arm 28 to the bracket 79. A plurality of attachments 83, such as conventional nuts, are fixedly coupled to the clamp 81. The arm 28 is attachable to the clamp 81 by attaching the connector 66 to a selectable one of the attachments 83.

In use, as stated above and shown in the Figures, the arm 28 is mounted to a desired support structure 84, such as a barbeque grill or the like, using the magnet 78, bracket 79 or clamp 81. The beverage container 19 is placed into the receiver 12 and supported above a ground surface by the receiver 12. The insulating material 22 keeps the contents of the beverage container 19 at a cool temperature while the beverage container 19 is positioned within the receiver 12. The arm 28 is pivoted to a selectable location to position the beverage container 19 where desired. After use, the device 10 can be dismounted from the structure. Alternatively, the arm 28 can be pivoted so that the device 10 is compactly stored adjacent to the support structure 84 to which the device 10 is mounted.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A beverage container holding device comprising:

a receiver having a bottom wall and a perimeter wall coupled to and extending upwardly from said bottom wall, said bottom wall and said perimeter wall defining an interior space of said receiver configured to receive a beverage container therein, an upper edge of said receiver defining an access opening into said receiver; and an arm coupled to said receiver, said arm being configured for attaching to a support structure to support the beverage container from the support structure, said arm being movable such that said receiver is configured to be positionable at a selectable location relative to the support structure, said arm comprising a first member pivotally coupled to a second member;

a connector coupled to and extending outwardly from said second member, said connector having a threaded section;

an attachment member coupled to said connector, said attachment member being configured for attaching said arm to the support structure; and a magnet being releasably coupled to said second member, said magnet having an opening extending therethrough, said opening being threaded complementarily relative to said threaded section of said connector wherein said magnet is configured to threadably engage said connector to support said magnet on said arm.

2. The device of claim 1, further comprising an insulating material coupled to said receiver wherein said insulating material is configured for preventing heat transfer between said interior space and an extrinsic environment relative to said interior space through said receiver.

3. The device of claim 2, further comprising said insulating material lining an inner surface of said perimeter wall.

4. The device of claim 2, further comprising a hole positioned in said bottom wall of said receiver.

5. The device of claim 1, further comprising each of said first and second members having an outer end and an inner end, said first and second members being coupled together at said inner ends.

6. The device of claim 5, further comprising:

an upper plate coupled to a top surface of said first member and a top surface of said second member, said upper plate extending between said first and second members proximate said inner ends; and a lower plate coupled to a bottom surface of said first member and a bottom surface of said second member, said lower plate extending between said first and second members proximate said inner ends.

7. The device of claim 6, further comprising:

a first fastener extending through each of said first member, said upper plate and said lower plate, said first fastener releasably coupling a first end of said upper plate and a first end of said lower plate to said first member proximate said inner end of said first member; and a second fastener extending through each of said second member, said upper plate and said lower plate, said second fastener releasably coupling a second end of said upper plate and a second end of said lower plate to said second member proximate said inner end of said second member.

8. The device of claim 1, further comprising a coupler coupled to said arm, said coupler coupling said arm to said receiver.

9. The device of claim 8, further comprising an aperture positioned in said perimeter wall of said receiver, said aperture being configured to receive said coupler therethrough to releasably couple said arm to said receiver.

10. The device of claim 9, further comprising said coupler being threaded, said aperture being threaded complementarily to said coupler wherein said coupler is configured to threadably engage said aperture.

11. The device of claim 1, further comprising a coupler coupled to and extending outwardly from said first member, said coupler coupling said arm to said receiver.

12. The device of claim 1, further comprising said second member having an outer end positioned distally relative to said first member, said connector having an upper portion extending into said second member proximate said outer end of said second member.

13. A beverage container holding device comprising:

a receiver having a bottom wall and a perimeter wall coupled to and extending upwardly from said bottom wall, said bottom wall and said perimeter wall defining an interior space of said receiver configured to receive a beverage container therein, an upper edge of said receiver defining an access opening into said receiver;

an insulating material coupled to said receiver wherein said insulating material is configured for preventing heat transfer between said interior space and an extrinsic environment relative to said interior space through said receiver, said insulating material lining an inner surface of said perimeter wall;

a hole positioned in said bottom wall of said receiver;

an arm coupled to said perimeter wall of said receiver, said arm having a first member and a second member, each of said first and second members having an outer end and an inner end, each of said inner ends being convexly arcuate, said first and second members being pivotally coupled together at said inner ends;

an upper plate coupled to a top surface of said first member and a top surface of said second member, said upper plate extending between said first and second members proximate said inner ends;

a lower plate coupled to a bottom surface of said first member and a bottom surface of said second member, said lower plate extending between said first and second members proximate said inner ends;

a first fastener extending through each of said first member, said upper plate and said lower plate, said first fastener releasably coupling a first end of said upper plate and a first end of said lower plate to said first member proximate said inner end of said first member;

a second fastener extending through each of said second member, said upper plate and said lower plate, said second fastener releasably coupling a second end of said upper plate and a second end of said lower plate to said second member proximate said inner end of said second member;

a coupler coupled to and extending outwardly from said first member, said coupler being threaded, said coupler coupling said arm to said receiver;

an aperture positioned in said perimeter wall of said receiver, said aperture being threaded complementarily to said coupler wherein said coupler is configured to threadably engage said aperture;

a connector coupled to and extending outwardly from said second member, said connector having an upper portion and a lower portion, said upper portion being transversely positioned relative to said lower portion, said upper portion having an upper end extending into said second member proximate said outer end of said second member, said lower portion having a threaded section; and an attachment member coupled to said connector, said attachment member being configured for attaching said arm to the support structure, said attachment member comprising a bracket.

* * * * *